United States Patent [19]

Weisberg et al.

[11] 4,073,700

[45] Feb. 14, 1978

[54] PROCESS FOR PRODUCING BY ELECTRODEPOSITION BRIGHT DEPOSITS OF GOLD AND ITS ALLOYS

[76] Inventors: Alfred M. Weisberg, 48 Barberry Hill, Providence, R.I. 02906; Harry Kroll, 408 Fair St., Warwick, R.I. 02888

[21] Appl. No.: 702,041

[22] Filed: July 2, 1976

Related U.S. Application Data

[63] Continuation of Ser. No. 556,691, March 10, 1975, abandoned, which is a continuation of Ser. No. 425,182, Dec. 17, 1973, abandoned, which is a continuation of Ser. No. 319,157, Dec. 29, 1972, abandoned, which is a continuation of Ser. No. 166,030, July 26, 1971, abandoned.

[51] Int. Cl.[2] ..... C25D 3/48; C25D 3/62

[52] U.S. Cl. ..... 204/43 G; 204/46 G

[58] Field of Search ..... 204/46 G, 43 G, 44, 204/109, 110, 123; 106/1; 260/502.5

[56] References Cited

U.S. PATENT DOCUMENTS

| | | | |
|---|---|---|---|
| 2,673,214 | 3/1954 | Bersworth et al. | 260/502.5 |
| 2,961,311 | 11/1960 | Bersworth et al. | 260/502.5 X |
| 3,293,176 | 12/1966 | White | 260/502.5 X |
| 3,394,172 | 7/1968 | Schiefer | 260/502.5 |
| 3,617,343 | 11/1971 | Kandler et al. | 260/502.5 X |
| 3,672,969 | 6/1972 | Nobel et al. | 204/43 G |

*Primary Examiner*—G. L. Kaplan

*Attorney, Agent, or Firm*—Eugene E. Geoffrey, Jr.

[57] ABSTRACT

This invention discloses a process for producing by electrodeposition bright deposits of gold and its alloys at greatly increased speeds and with an evenness of distribution significantly greater than conventional baths resulting in considerable savings in the average amount of gold deposited to meet a minimum thickness specification. The deposition of gold is promoted and enhanced by the presence of chelating agents characterized as carboxymethylated aminomethylene phosphonic acids and its salts.

8 Claims, 1 Drawing Figure

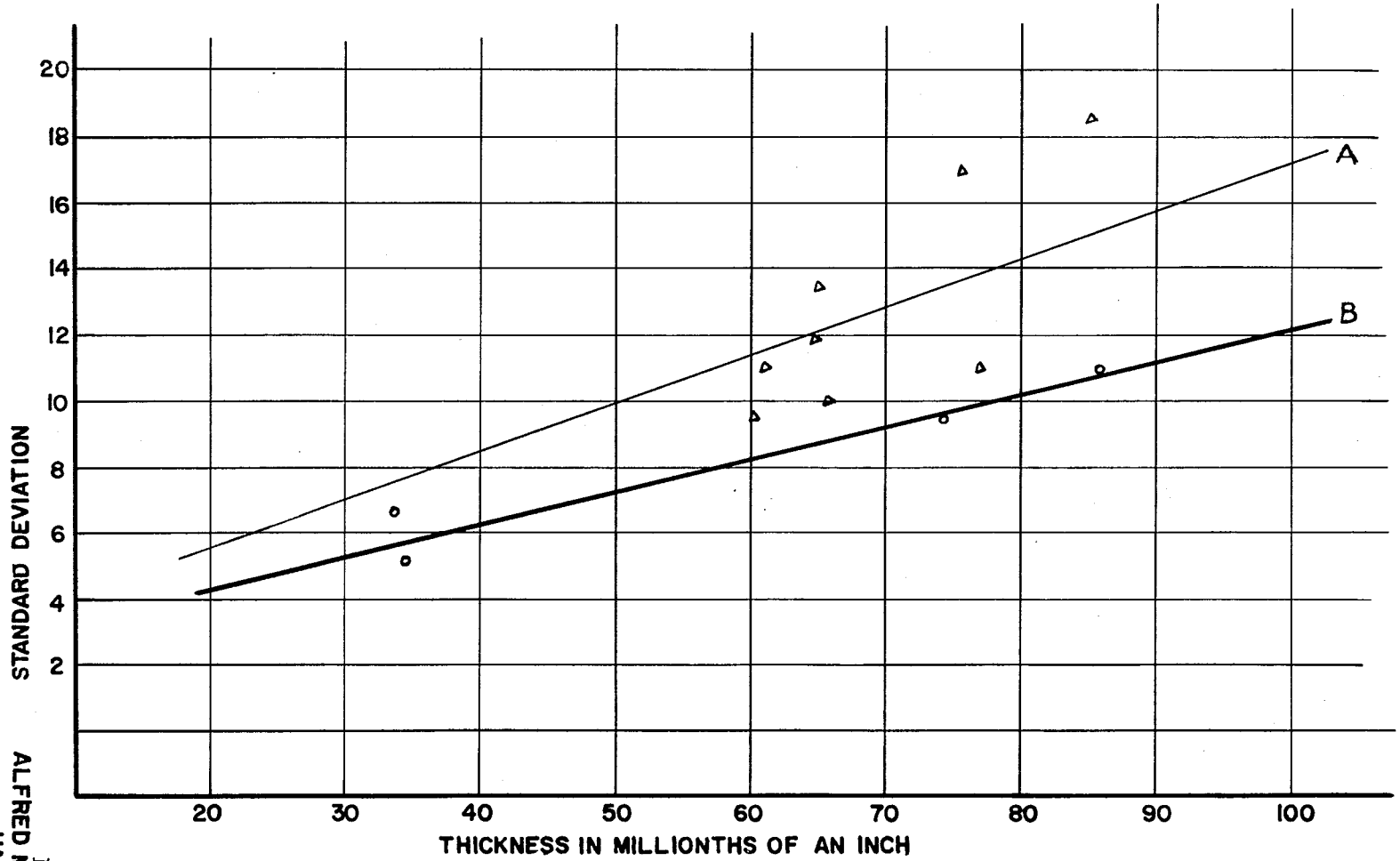
INVENTORS
ALFRED M. WEISBERG
HARRY KROLL
BY
ATTORNEY

PROCESS FOR PRODUCING BY ELECTRODEPOSITION BRIGHT DEPOSITS OF GOLD AND ITS ALLOYS

RELATED APPLICATIONS

This application is a continuation of our copending application Ser. No. 556,691 filed Mar. 10, 1975, which in turn is a continuation of application Ser. No. 425,182 filed Dec. 17, 1973, which in turn is a continuation of application Ser. No. 319,157 filed Dec. 29, 1972, which in turn is a continuation of application Ser. No. 166,030 filed July 26, 1971, all now abandoned, and assigned to the assignee of the instant application.

BACKGROUND OF THE INVENTION

It is standard practice to electroplate gold from solutions of potassium aurocyanide containing weak organic acids and their salts to buffer the plating solution at a selected pH. The baths may be operated when used for barrel plating at a limiting current density of about 1-2 amperes per square foot. Although satisfactory deposits are obtained under these conditions, the acidity of an acid bath may attack the basis metal and the plating bath may be economically too slow for certain applications. Increasing the current density to increase the speed of deposition results in foxy scum or burned deposits that are not acceptable or structurally sound.

Besides the deposition in pure form, gold is frequently plated from baths containing cobalt, nickel, zinc, copper and indium to form an alloy. The metallic additives are electrodeposited with the gold to produce alloys which have useful and valuable properties. To control the amount of alloying metal in the deposit, chelating agents such as glycine, diethyl glycine, nitrilotriacetic acid, ethylene diamine diacetic acid, imino diacetic acid, ethylene diamine tetracetic acid, diethylene triamine pentaacetic acid, cyclohexane diamine tetraacetic acid and related compounds have been used to control the concentration of the alloying metal ion in the plating bath and, therefore, regulating the amount of metal which is alloyed with the gold deposit. These compounds, known as amino carboxylic acid chelating agents, because of their affinity for the alloying metal ion, function as metal ion buffers in controlling the concentration of free metal ion in the plating bath which in turn controls the amount of metal alloyed with the gold deposit.

Other types of chelating agents have been used in the electroplating of metals. In U.S. Pat. No. 3,475,293, organic phosphonic acids have described for use in ferrous and non-ferrous metal plating baths. The use of organic phosphonic acid in gold plating baths has been disclosed in British Pat. No. 1,198,527. The cited patent ascribes two functions to the phosphonic acid, (1) as a metal chelating agent and (2) as a brightening agent.

Studies on the chelating agents of the aminoethylene phosphonic acid types indicate that their affinities for metal ions such as cobalt, nickel, iron, zinc and copper are less than those of the corresponding aminomethylenecarboxylic acid. The affinity of a chelating agent for a metal ion is defined in this context as a stability constant. The measurement of these values is described in "The Determination of Stability Constants" by F. J. C. Rossati and H. Rossatti, McGraw-Hill Book Company, 1961. Stability constants for aminomethylene phosphonic acid are described by S. Westerback, K. S. Rajan and A. E. Martell in the J. Am. Chem. Soc. 87,2567 (1965).

The synthesis of chelating agents containing both aminomethylene carboxylic acids and aminomethylene phosphonic acids has been described by K. S. Rajan, I. Murase and A. E. Martell, J.Am.Chem. Soc., 91,4400 (1969) and G. Schwarzenbach, H. Ackerman and R. Ruchstuhl, Helv. Chem. Acta 32,1175 (1949). The mixed aminomethylene carboxylic acids -aminomethylene phosphonic acids may be prepared by reacting primary and secondary amino acids with formaldehyde and phosphorous acid by the method disclosed in U.S. Pat. No. 3,288,846.

DESCRIPTION OF THE INVENTION

We have found that chelating agents containing the combined aminomethylene carboxylic acid and aminomethylene phosphonic acids and their water soluble salts, hereinafter referred to as carboxylic phosphonates, when added to gold plating baths improve the performance of the bath in the distribution of the gold plate, over conventional baths. The improvements are seen as more evenly distributed, brighter yellow gold deposits at higher limiting current densities and higher plating efficiencies at higher current densities. Furthermore, these new chelating agents are found to be effective regulators of alloying metal ions such as copper, cobalt, and nickel, in the electrodeposition of gold alloys containing these metals. They are so effective that bright hard gold deposits of purities in excess of 99.7% gold are possible.

In the FIGURE we have illustrated both performance in terms of curves showing thickness distribution on plated items.

The compounds which fall within the scope of this invention cannot be conveniently described by a single formula. For the purpose of this invention, they are conveniently divided into two groups, those based on a single nitrogen atom and those based on more than a single nitrogen atom.

Group I

Carboxymethyl Nitrilomethylene Phosphonic Acids.

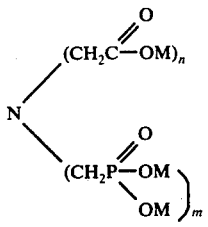

wherein: $n$ and $m$ is either 1 or 2, and $n + m = 3$; M is hydrogen or an alkali metal cation, such as sodium or potassium.

GROUP II

Carboxymethylated Alkylene Polyaminomethylene Phosphonic Acids.

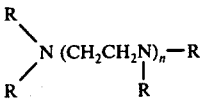

wherein: $n$ is 1, 2 or 3 and R may be either

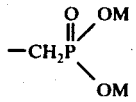

or — $CH_2COOM$, but at least one one R group must be either a methylenecarboxylic acid or a methylene phosphonic acid and M is hydrogen or an alkali metal cation, such as sodium or potassium.

Examples of these compounds are:

GROUP I

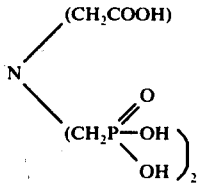

N - Carboxymethyl imino di(methylene phosphonic acid)

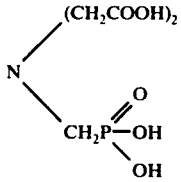

N,N- di(carboxymethyl) aminomethylene phosphonic acid.

Group II

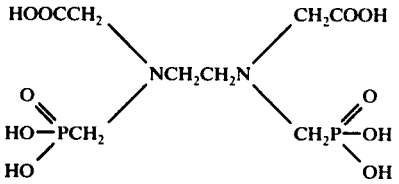

N,N'- di(carboxymethyl) 1,2-Ethylenediamine N,N'- di(methylene phosphonic acid)

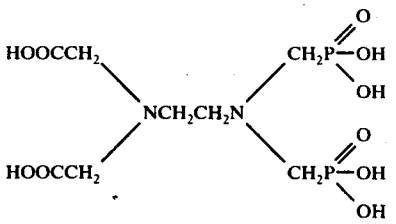

N,N - di(carboxymethyl) 1,2-Ethylenediamine N',N'- di(methylene phosphonic acid)

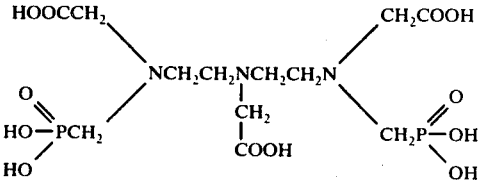

N,N',N''- Tris(carboxymethyl) diethylenetriamine N,N''- di(methylenephosphonic acid)

In the drawing we have plotted some results reporting the distribution of thickness of gold plate in millionths of an inch from a conventional plating bath, and from baths made according to this invention, using barrel plating of multi-lead transistors. (12-pin transistors.)

The plate thicknesses were measured and standard deviations from the mean calculated and plotted. Curve A shows the standard deviations obtained at given thicknesses in millionths of an inch. The straight line drawn is a mathematically sound curve for the points indicated by the triangular spots.

The standard deviation was plotted for baths made in accordance with the instant invention using the phosphonic acid additives as shown in Examples I – V.

The data plotted for the baths made in accordance with this invention, namely, curve B, clearly show that when plating to attain any thickness standard deviation is considerably less than it is with the conventional bath.

The two curves when extrapolated back to "0" thickness intersect at "0" deviation. That is, they are mathematically sound.

In production terms the significance of this kind of information is that the thickness of gold called for by specification on a given part is met with less total gold and a higher degree of certainty with baths containing the phosphonic acid component than with the standard bath. It is also important to observe with increasing thicknesses of plate the standard deviation attained in the standard bath becomes quite great, whereas that in accordance with the instant bath is minimized.

The standard bath used corresponds to the following: 12½ grams of potassium gold cyanide is dissolved in approximately 500 milliliters of water. The pH of this solution is adjusted to 6.5 with dilute phosphonic acid or a weak organic acid and the volume of solution made up to one liter; to this is added 45 grams of monopotassium phosphate and 125 grams of potassium citrate. Copper-plated test pieces were electroplated at 145° F and a current density of 2 amperes/square foot, for a period of ten minutes.

A satin gold deposit was obtained.

The carboxymethylated phosphonic acids can be used with the commercially available conventional gold cyanide baths to produce bright gold or gold alloy deposits. The additives are particularly useful in those baths employing organic acids, such as citric or malic acid, their water soluble alkali metal salts, or as the ammonium or organic amine salts. When used in conjunction with organic acids, the brightening effect of the carboxylic phosphonic acids is considerably enhanced. Inorganic salts such as phosphates, polyphosphates. sulfamates, fluoroborates, etc., may be used together with the additives.

The plating baths may contain from 1 to 20 grams potassium aurocyanide per liter with the preferred concentration between 6 – 14 grams per liter.

Organic acid buffers useful with this invention are: (But others can be used)

| | | |
|---|---|---|
| 1. | Citric acid/potassium (or sodium) citrate (1:1 molar ratio) | 10–150 grams/liter |
| 2. | Malic acid/potassium malate (1:1 molar ratio) | 10–150 grams/liter |
| 3. | Citric acid/monopotassium dihydrogenphosphate (1:1 molar ratio) | 10–150 grams/liter |
| | Inorganic buffers useful in these plating baths are: | |
| 1. | Monopotassium dihydrogen/dipotassium hydrogen phosphate (1:1 molar ratio) | 40–100 grams/liter |
| 2. | Phosphoric acid/disodium hydrogen phosphate (1:2 molar ratio) | 5–100 grams/liter |
| 3. | Monopotassium hydrogen phosphate/Boric Acid (1:1 molar ratio) | 10–60 grams/liter |

The alloying metal salts are generally added in the bath at concentration between 0.01 – 25 grams/liter.

The amount of carboxylated phosphonic acid complexing agent brightener added to the working bath will depend upon the specific use. However, the concentration may range from 0.5 gram/liter to 400 grams/liter. If the purpose of the chelating agent is to control the amount of alloying metal in the deposit, the concentration of carboxylated phosphonic acid may range between 0.5 to 5.0 grams/liter. However, in those baths where the chelating agent acts as a brightening agent, and conductivity aid the concentration in the final bath may be between 50 to 300 grams/liter, or higher.

The invention may be illustrated by the following examples:

EXAMPLE 1

Twelve and one-half grams of potassium gold cyanide is dissolved in approximately 500 milliliters of water. To this solution is added 100 grams of N - Carboxymethyl imino di(methylenephosphonic acid). The pH of this solution is adjusted to 6.5 with 45 percent aqueous caustic potash solution and the volume of solution made up to 1 liter. Copper-plated test pieces were electroplated at 145° F. and a current density of 2 amperes/-square foot, for a period of 10 minutes.

A satin bright gold deposit was obtained.

EXAMPLE 2

To 500 milliliters of water was added 10.0 grams of potassium gold cyanide, 150 grams of N,N - di(carboxymethyl) ethylene diamine N,N - di(methylene phosphonic acid) and the solution neutralized to pH 8.0 by the addition of 45 percent aqueous caustic potash solution and the volume adjusted to 1 liter. Copper-plated 1-inch diameter disks were plated at 125° F for 10 minutes at 2.5 amperes per square foot.

A yellow lustrous deposit was obtained.

EXAMPLE 3

A gold plating bath was prepared which contained 12 grams per liter of potassium gold cyanide, 150 grams per liter of N,N,N - tris(carboxymethyl) diethylenetriamine N,N - di(methylenephosphonic acid, 2 grams per liter of nickel as $NiSO_4$ and had pH adjusted to 4.5 with caustic potash. It was used to electrodeposit a bright gold plate on nickel plated 1 inch diameter disks. The plating was carried out at 145° F at a current density of 2 amperes per square foot.

A highly reflective gold-nickel alloy deposit was obtained.

EXAMPLE 4

A gold plating bath was prepared having the following composition:

| | |
|---|---|
| Potassium Gold Cyanide | 8.0 grams/liter |
| Cobalt Sulfate | 1.5 grams/liter |
| Citric Acid | 50 grams/liter |
| Potassium Citrate | 50 grams/liter |
| N,N-di(Carboxymethyl) ethylenediamine N,N-di(methylenephosphonic acid) | 50 grams/liter |
| pH | 3.8 |
| Temperature | 100° F |
| Current Density | 5 amps/sq. ft. |

A bright gold deposit was obtained containing cobalt.

EXAMPLE 5

A plating bath having the following composition was prepared:

| | |
|---|---|
| Potassium Gold Cyanide | 8.0 grams/liter |
| Cobalt Sulfate | 0.75 grams/liter |
| Nickel Sulfate | 0.75 grams/liter |
| Citric Acid | 50 grams/liter |
| Potassium Citrate | 50 grams/liter |
| N-Carboxymethyl imino di(methylenephosphonic acid) | 15 grams/liter |
| pH adjusted to 4.5 | |

The bath was used at a current density of 10 amperes per square foot at a temperature of 90° F to obtain hard lustrous deposits.

EXAMPLE 6

| | |
|---|---|
| $KAu(CN)_2$ | 14 grams/liter |
| Cobalt Sulfate | 3 grams/liter |
| Citric Acid | 45 grams/liter |
| Potassium dihydroxygen phosphate | 50 grams/liter |
| N,N-di(Carboxymethyl) ethylenediamine N,N-di(methylenephosphonic acid) | 22 grams/liter |
| pH adjusted to 5.0 | |

Plating Conditions: 15 ASF, at 95° F.; bright hard deposit.

EXAMPLE 7

| | |
|---|---|
| Gold Cyanide, $KAu(CN)_2$ | 1 ounce/gallon of gold |
| Carboxymethylated phosphoric aids, N,N,N'-tri (carboxymethyl) ethylenediamine, N' methylene phosphoric acid | 16 ounces per gallon |

The solution thus made gives bright gold plate at 4 amperes per square foot, at 90° – 140° F, at pH 5 – 6.

The recipes of the examples are, of course, stated in specific terms. Actually conditions are variable, i. e., pH may be varied from 3 to 8 and alloying compounds used in amounts from 0.01 to 25 grams per liter.

Similar results obtained with the dimethylene phosphoric acid.

What is claimed is:

1. In a process for producing bright gold or gold-base alloy deposits, in a pH range between 3 and 8, from an aqueous solution containing a water soluble complex of gold cyanide, the improvement comprising carrying in solution in said solution a chelating agent selected from the group consisting of those represented by the formula:

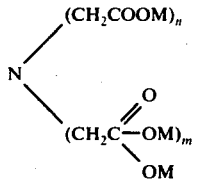

where $m$ and $n$ are either 1 or 2 and $m + n = 3$, and M is hydrogen or an alkali metal cation, and those represented by the formula:

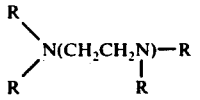

where $n$ is 1, 2, or 3 and R may be either

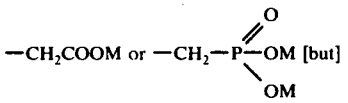

at least one R group being either a methylene carboxylic acid group or a methylenephosphonic acid group, and not all R's the same, and M is hydrogen or an alkali metal cation which process comprises electrolyzing said solution employing a metal object to be electroplated as a cathode in said electrolytic operation.

2. A process for producing bright gold or gold-base alloy deposits in a pH range between 3 and 8, from an aqueous solution containing a water soluble gold cyanide, an organic or inorganic acid and, as a component separate from said organic acid, 0.5 to 150 grams per liter of N-carboxymethyl imino di(methylenephosphonic acid) which comprises electrolyzing said solution employing a metal object to be electroplated as a cathode.

3. In a process for producing bright gold or gold-base alloy deposits in a pH range between 3 and 8 from an aqueous solution containing a water soluble gold cyanide, an organic acid to adjust pH and its ammonium or alkali metal salts, the improvement comprising adding to said solution as a component separate from said organic acid 0.5 to 150 grams per liter of N,N' -di(carboxymethyl) aminomethylene phosphonic acid and electrolyzing said solution employing a metal object to be electroplated as a cathode in such electrolytic operation.

4. A process in accordance with claim 3 wherein the bath contains a nickel salt as a source of alloying nickel in the amount of 0.01 gram to 25 grams per liter.

5. A process in accordance with claim 3 wherein the bath contains a cobalt salt as a source of alloying cobalt in the amount of 0.01 gram to 25 grams per liter.

6. A process in accordance with claim 3 wherein the bath contains a nickel salt and a cobalt salt as alloying metals in the total amount of 0.1 gram to 25 grams per liter.

7. In a process for producing bright gold or gold-base alloy deposits in the pH range between 3 and 8 from an aqueous solution containing a water soluble gold cyanide, an organic acid to adjust pH and its ammonium or alkali metal salts the improvement comprising adding to said solution as a component separate from said organic acid 0.5 to 150 grams per liter of N,N'-di(carboxymethyl) 1,2 -ethylenediamine N,N' -di(methylene phosphonic acid)

and electrolyzing said solution employing a metal object to be electroplated as a cathode in such electrolytic operation.

8. In a process for producing bright gold or gold-base alloy deposits in a pH range between 3 and 8, from an aqueous solution containing a water soluble gold cyanide, an organic acid to adjust pH and its ammonium or alkali metal salts the improvement comprising adding to said solution as a component separate from said organic acid 0.5 to 150 grams per liter of N,N' -di(carboxymethyl) 1,2 -ethylenediamine N,N' -di(methylenediphosphonic acid)

and electrolyzing said solution employing a metal object to be electroplated as a cathode in such electrolytic operation.

* * * * *